United States Patent [19]

Williams

[11] 4,438,975

[45] Mar. 27, 1984

[54] ARMREST FOR A SEAT

[75] Inventor: Ralph J. Williams, New Oxford, Pa.

[73] Assignee: Dentsply Research & Development Corp., Milford, Del.

[21] Appl. No.: 390,015

[22] Filed: Jun. 21, 1982

[51] Int. Cl.[3] ..... A47C 7/54

[52] U.S. Cl. ..... 297/412; 297/417; 188/82.3; 188/82.84

[58] Field of Search ..... 297/349, 412, 417, 411; 248/122, 240, 289.1, 296; 188/82.3, 82.34, 82.4, 188/82.84; 403/59, 61, 351, 352

[56] References Cited

U.S. PATENT DOCUMENTS

| | | | |
|---|---|---|---|
| 1,706,634 | 3/1929 | Seils . | |
| 2,592,702 | 4/1952 | Sprung | 297/417 |
| 2,754,947 | 7/1956 | Marsden | 188/82.84 X |
| 3,017,964 | 1/1962 | Von Thuengen | 188/82.84 |
| 3,829,159 | 8/1974 | Leffler . | |
| 3,950,027 | 4/1976 | Wilson . | |
| 4,085,967 | 4/1978 | Spencer . | |
| 4,118,069 | 10/1978 | Hunter . | |

FOREIGN PATENT DOCUMENTS

| | | | |
|---|---|---|---|
| 1805645 | 8/1970 | Fed. Rep. of Germany | 297/411 |

*Primary Examiner*—Francis K. Zugel
*Assistant Examiner*—James R. Brittain
*Attorney, Agent, or Firm*—C. Hercus Just

[57] ABSTRACT

An armrest for a seat such as a stool having a post extending upwardly from an edge of the seat and supporting a substantially horizontal arm which is connected to the upper end of the post by a one-way clutch permitting pivotal movement of the arm in one direction around the axis of the post but preventing reverse pivotal movement of the arm and the mounting of the clutch on the post permitting limited vertical movement of the arm and clutch relative to the post to deactivate the clutch relative to the post to permit rotation of the arm relative to the post in the aforementioned reverse direction thereof.

6 Claims, 6 Drawing Figures

28
32
46
44
6
42
56
40
24
36
58
54
22
48
30
6
38

48
52
30
42
52

50
52
48
42
52
30
44
52

36
38
44
30
48
52
4
32
56
24
58
28
46
50
4
52
42
40
22
34

ARMREST FOR A SEAT

BACKGROUND OF THE INVENTION

In recent years, more and more use is being made of stools in dental operatories, as well as in other types of operatories, where it is desired to have an arm, frequently of a curved nature, pivotally mounted for adjustable positioning within a horizontal plane parallel to the seat with which the arm is associated. The user of such stools, such as either a dental assistant or a dentist, or other medical personnel, sometimes uses such arms as a backrest or an armrest and, in certain circumstances, as a rest against which the abdomen or chest of the operator is disposed for suitable support incident to conducting certain medical operations, dental or otherwise. The present invention particularly is concerned with pivotal support of an arm, including a curved arm, associated with a stool or other form of seat so that the position of the arm may be adjusted, as desired by the person sitting upon the seat, and thereby dispose the arm as best suited for certain operations by the person on the seat. The invention is particularly concerned with clutch means to control such positioning of the arm.

The pivoting of support arms relative to seats is a matter that has been dealt with in a number of prior circumstances. By way of example, one prior U.S. Pat. No. 1,706,634, to Seils, dated Mar. 26, 1929, concerns an armrest adjustably supported relative to the door of an automobile adjacent the seat for the driver. Various positions are possible by means of a ball and socket arrangement, as well as a vertical pivot.

In dental stools in which patients are supported, it also has been desirable to provide one or more of the arms at opposite sides of the seat of the dental chair with means to pivot the arm either sidewise or upward to facilitate the seating or removal of a patient with respect to the chair and various positioning means have been devised, as illustrated, for example, in prior U.S. Pat. Nos. 3,829,159 to Leffler, dated Aug. 13, 1974 and 3,950,027 to Wilson, dated Apr. 13, 1976.

Still another prior U.S. Pat. No. 4,085,967 to Spencer, dated Apr. 25, 1978, and assigned to the same assignee as the instant invention, pertains to a dental operatory stool in which a curved arm is adjustable with respect to a seat for purposes of moving the arm laterally, as distinguished from about a vertical pivot relative to the seat, the arm of said stool being similar to the arm of the present invention, as far as shape is concerned, and also is supported at the upper end of a plurality of arms having portions extending vertically above the level of the seat of the chair or stool.

Another relatively simple structure for pivotally supporting arms on the frame of a seat or chair for movement in vertical planes comprises the subject matter of prior U.S. Pat. No. 4,118,069 to Hunter, dated Oct. 3, 1978.

While the foregoing patents illustrate certain pivotal means and position-retaining mechanism for arms movable relative to seats of various kinds, they fail to provide an arm of the type comprising the present invention for the purpose described below with respect to said invention.

SUMMARY OF THE INVENTION

It is among the principal objects of the present invention to provide, particularly for use with an operatory chair or stool, an arm which is pivotally movable about a vertical post extending upward from one edge of a seat of a chair or stool and adapted to be moved freely in one direction about a vertical axis to dispose the arm as desired by the user and, particularly after the arm has been disposed in the desired position, prevent reverse pivotal movement of the arm in order that the person occupying the chair or stool may rest in any desired manner against the arm, either with the body of the person or their arm, but when it is desired to move the arm for any other purpose in reverse direction to that mentioned above, the present invention provides means to deactivate a clutch, which normally prevents reverse direction, and render the same inactive to permit such reverse direction of movement.

Another object of the invention is to mount the arm upon a socket extending downwardly and receiving the upper end of a vertical post extending to a level above that of the seat, and the clutch member which is preferably of a circular nature, is disposed wthin said socket and engages selectively one of several sections of the upper end of the post, respectively of different diameters, the section of larger diameter permitting the clutch to engage said section to prevent said reverse direction of rotation of the arm, while when the arm and socket, together with the clutch, are moved vertically to dispose the clutch adjacent the smaller diameter section of the upper end of the post, said clutch will be deactivated and permit reverse rotation of the arm to any extent desired.

A further object of the invention is to provide the arm and post, as well as the clutch mechanism, with means to restrict upward movment of the arm, socket and clutch beyond the section of the post of smaller diameter in which the clutch is inactive.

Still another object of the invention is to employ a clutch of circular nature, having an outer ring member which has a circular arrangement of clutch members engageable respectively with wedging configurations to comprise a one-way clutch.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
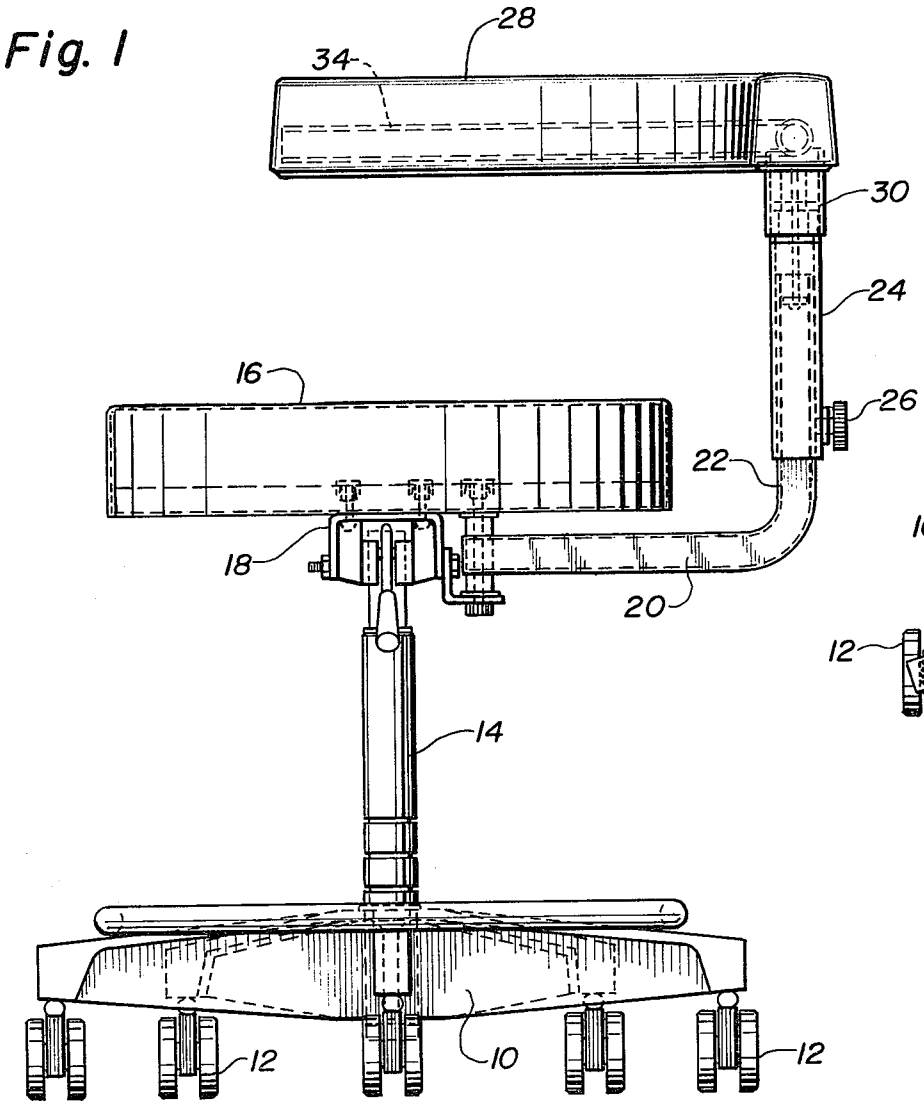
FIG. 1 is a side elevation of an exemplary operatory stool, including a seat and relatively movable arms embodying the principles of the present invention.

Referring to FIG. 1, there is illustrated an exemplary chair or stool to which the present invention is applicable. The specific illustration comprises a dental operatory chair but it is to be understood that the invention is not to be restricted to that specific type of chair, seat or stool, and rather, is applicable to other types of seats where it is desired to have an arm adjustably positionable with respect to a seat in accordance with the principles of the invention.

Figure 2:
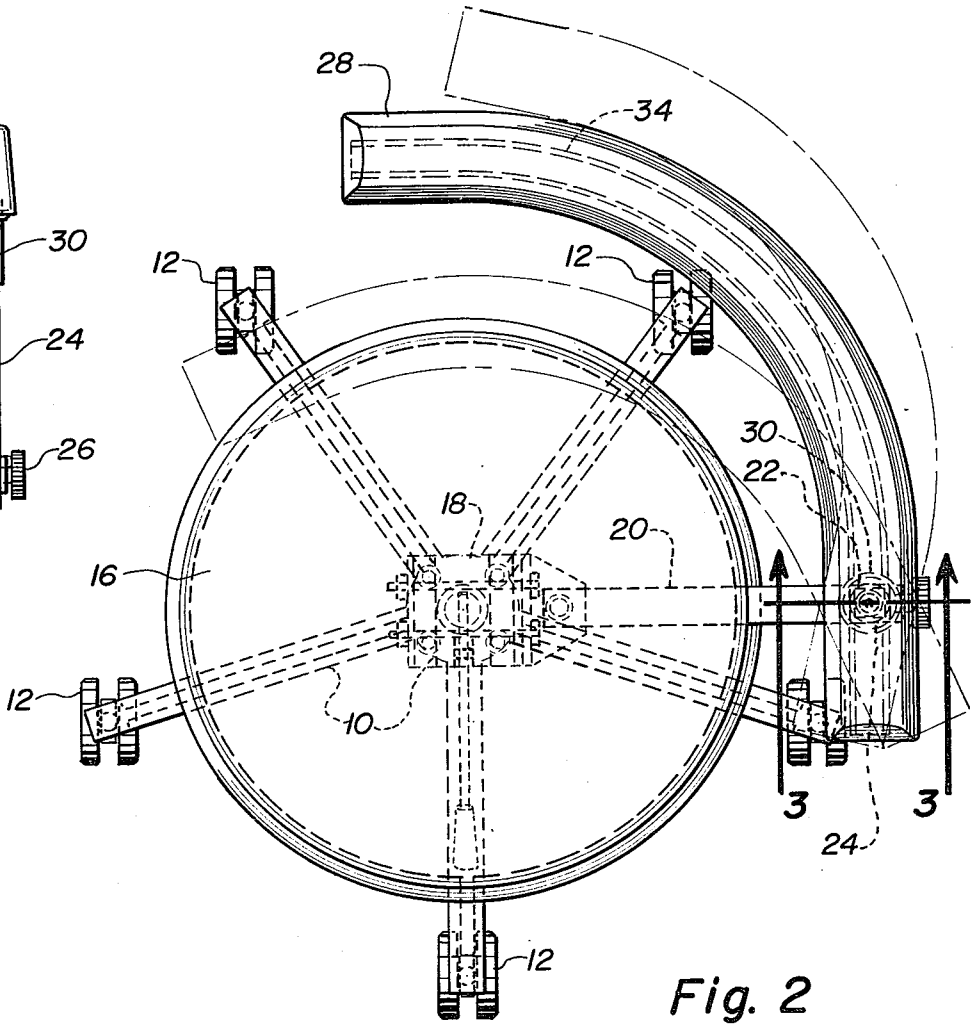
FIG. 2 is a top plan view of the exemplary operatory stool shown in FIG. 1 and illustrating in full lines, one position of the arm with respect to the seat of the stool, while in phantom, several adjusted positions of the arm are shown with respect to the seat.

The exemplary seat or stool shown in FIGS. 1 and 2 comprises a base 10, shown in the form of a spider having arms upon which casters 12 are mounted in the outer ends. A central post or standard 14 extends vertically upward from the base 10, and at the upper end of the post 14, an exemplary seat 16 is supported by being attached by means of a bracket 18 to the upper end of post 14. Extending laterally from the seat 16 is a horizontal arm 20, which terminates in a vertically extending post portion 22 disposed adjacent one edge of the seat 16, the latter supporting a post 24, which, for example, may be tubular to receive the vertical post portion 22 and the post 24 is held in vertically adjusted position with respect to the portion 22 by means of a hand screw 26, or otherwise. The invention primarily is concerned with the post 24 and the arm 28 supported by and extending laterally with respect to the upper end of post 24.

As shown in FIG. 2, the arm 28 preferably is curved and adjacent one end thereof, a downwardly extending socket 30 is connected. The arm 28 preferably is of an upholstered type and is provided with yieldable cushion material 32. A metal tube 34 is disposed within the arm 28 to afford rigidity and support therefor, the end 36 of the tube 34 being welded, for example, to a block 38, or otherwise securely fastened within the upper end portion of socket 30, which is preferably tubular, as clearly shown in FIGS. 3 and 5.

Figure 5:
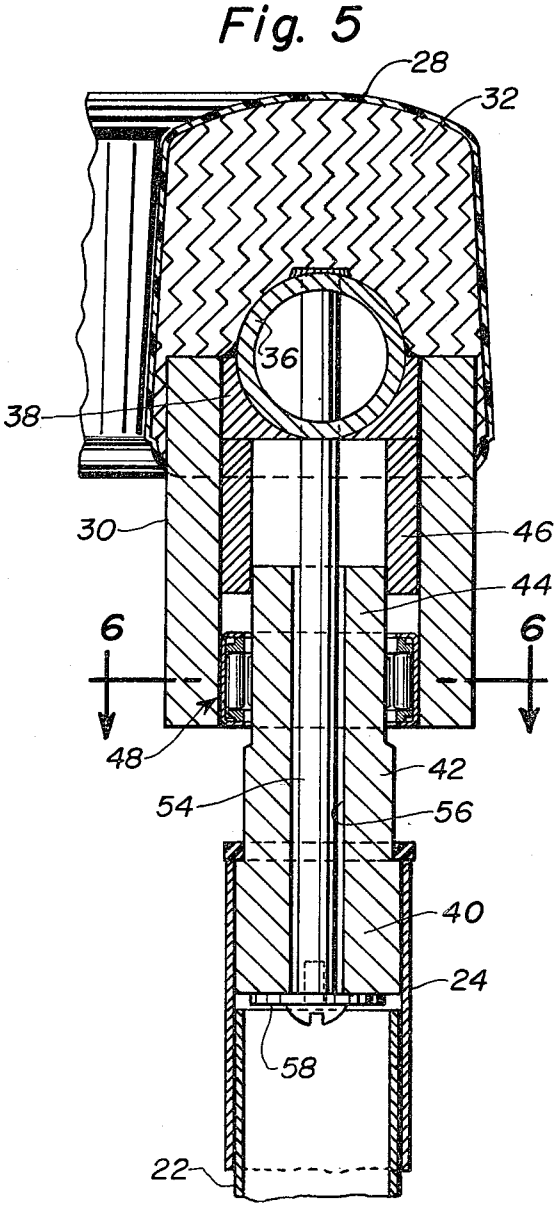
FIG. 5 a view similar to FIG. 3 but in which the arm and clutch member have been moved to inactive position with respect to the post, which is received within the socket on the arm.
Figure 4:
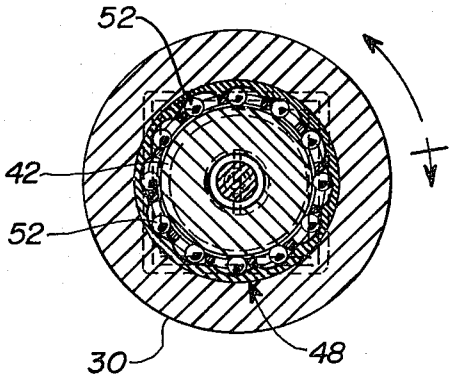
FIG. 4 is a transverse sectional view of the mechanism shown in FIG. 3, as seen on the line 4—4 thereof.
Figure 6:
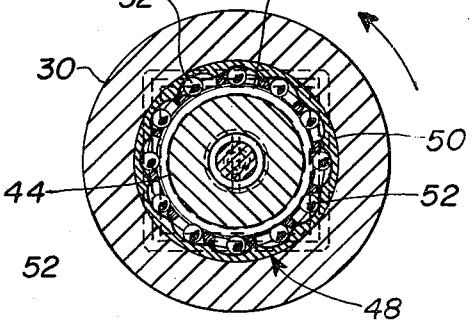
FIG. 6 is a transverse sectional view of the clutch disposed in inoperative position, as seen on the line 6—6 of FIG. 5.
Figure 3:
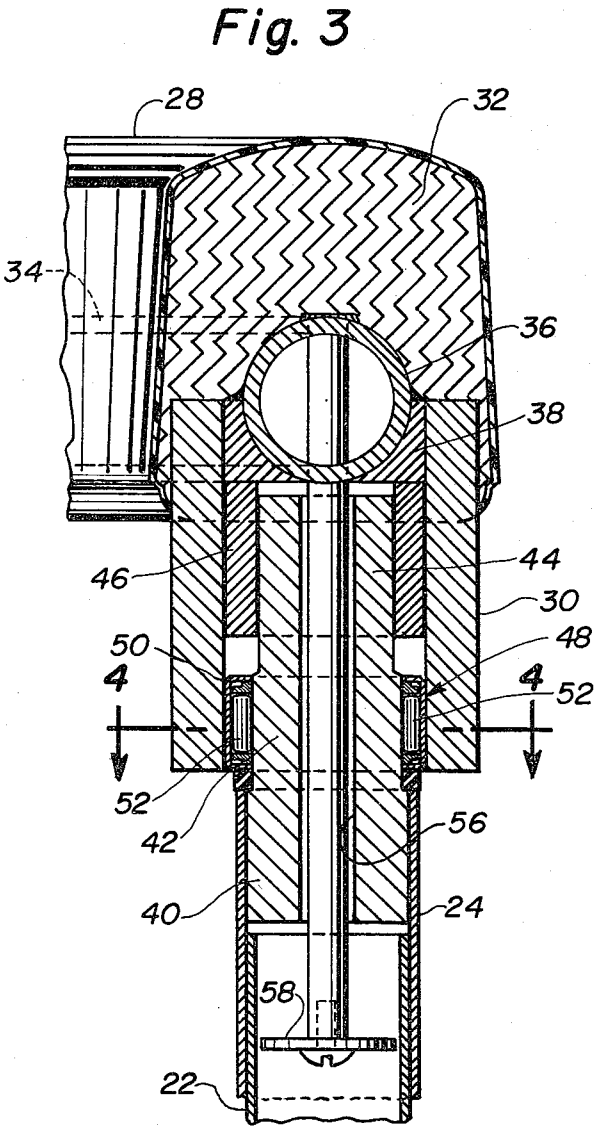
FIG. 3 is a fragmentary vertical elevation of portions of the arm and the post supporting the same, as seen on the line 3—3 of FIG. 2, and illustrated on a larger scale than in FIG. 2.

Normally, the post 24 is relatively fixed with respect to seat 16, unless vertical adjustment is desired by means of the hand screw 26. The upper end of post 24 is provided with a cylindrical member 40, having three diameters which are best illustrated in FIGS. 3 and 5. The largest section is lowermost and, for practical purposes, may actually be considered part of the post 24. The intermediate portion 42 is of a smaller diameter than the lowermost portion 40, while the uppermost portion 44 is of a still smaller diameter than the intermediate portion 42. For purposes hereinafter, in both the specification and claims, the intermediate portion 42 is referred to as the larger portion, while the uppermost portion 44 is referred to as the smaller portion. The smaller portion 44 is slidably received within a filler ring 46, especially to maintain vertical alignment of the socket 30 with respect to post 24. The filler ring 46 also preferably is fixed with respect to the inner bore of the socket 30. The lower portion of the socket 30 also closely receives a one-way clutch 48 of commercial type, details of which are best shown in FIGS. 4 and 6, in which the clutch is shown in cross-section. In these latter figures, it will be seen that the one-way clutch 48 comprises an outer ring portion 50, which, for example, may be press-fitted ihto the bore of the socket 30, the inner surface of the ring portion 50 having a series of circumferentially spaced wedging portions relative to which cylindrical clutch members 52 are positioned to permit free rotation of the socket 30 with respect to the larger portion 42 within cylindrical member 40 which is fixed with respect to post 24, when the arm 28 is moved in one direction, but reverse direction thereof will be prevented by the wedging action of the members 52 with respect to the outer ring portion 50 in known manner.

The principal advantage of the present invention lies in the fact that when a person desires to be seated upon the stool that adjusts the arm 34 to that person's liking, the arm 28 initially is in the position shown in FIG. 3 with respect to the post 24. This is the lower position in which the clutch 48 is operative to permit unidirectional rotation and prevent reverse rotation in view of the wedging action of the clutch members 52.

Assuming that it is desired by the user to move the arm 28 in reverse direction with respect to post 24 in order to achieve a desired resting position for the arm 28, this can be accomplished by raising the arm 28, socket 30 and clutch 48 to the position shown in FIG. 5 in which the clutch 48 is disposed opposite the smaller portion 44 of the cylindrical member 40 and in which position, as shown in FIG. 6, the clutch members 52 are out of engagement with the circumference of the smaller portion 44, whereby the clutch has no affect, and the arm 28 may be moved in reverse direction to any extent desired. The operative position of the clutch with respect to the larger portion 42 of the cylindrical member 40 is shown in FIG. 4 in which the clutch members 52 frictionally engage the circumference of the larger portion 42 of cylindrical member 40.

After the aforementioned adjustment in reverse direction has been achieved, the arm 28 then may be lowered to dispose the clutch 48 so that its clutch members 52 engage the circumference of the larger portion 42 of cylindrical member 40, as shown in FIG. 3.

For purposes of limiting the aforementioned vertical movement, the structure of the present invention comprises a shaft 54, which is fixed in its upper end to the end 36 of the tube 34 and extends downwardly through a suitable central opening 56 in cylindrical member 40, and the lower end of the shaft 54 has a stop member 58 secured thereto, as clearly shown in FIGS. 3 and 5 for abutment against the lower end of the cylindrical member 40 when the arm 28 is in the upper position, as shown in FIG. 5, thus preventing separation of the arm 28 and socket 30, as well as clutch 48, with respect to the post 24.

From the foregoing, it will be seen that the present invention provides a simple, highly effective adjustment means for positioning an arm with respect to a seat to achieve any desired relative position preferred by a user by initially providing unidirectional rotation and subsequently, when desired, permitting rotation in reverse direction to that originally permitted.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. An arm rest arrangement for a seat such as a stool and the like comprising a seat member, a post extending perpendicularly relative to an edge of said seat and having sections of two different diameters in axial alignment, a one-way clutch movably supported upon the upper end of said post, an arm connected to said clutch and extending laterally relative to said post, said clutch being circular and being connected to said arm and movable axially upon said post between said sections of different diameters thereof and when engaging said section of larger diameter permitting rotation of said arm in one direction upon said post but preventing reverse direction and when said clutch is disposed upon the post section of smaller diameter said clutch is deactivated to permit rotation of the arm about the axis of the post in said reverse direction.

2. The arm rest according to claim 1 in which said circular clutch has a circular arrangement of clutching members engageable with said section of said post of larger diameter and mounted within a ring activating member to lock said arm against rotation in said reverse direction but permit rotation in said one direction.

3. The arm rest according to claim 1 in which said section of said post of smaller diameter is above said section of larger diameter, said section of larger diameter having a length substantially equal to the height of said clutch.

4. The arm rest according to claim 3 further including means operable to prevent axial movement of said arm and clutch beyond said section of said post of smaller diameter.

5. The arm rest according to claim 1 in which said arm rest has a socket depending therefrom and receiving the upper end portion of said post, and said one-way clutch being mounted within the lower end portion of said socket.

6. The arm rest according to claim 5 in which said socket also contains a filler ring comprising a bearing rotatably and slidably receiving the section of smaller diameter of said post and cooperating with said clutch when disposed upon the post section of larger diameter to prevent tilting of said arm when said bearing is thus positioned.

* * * * *